US007557765B2

(12) United States Patent
Lai et al.

(10) Patent No.: US 7,557,765 B2
(45) Date of Patent: Jul. 7, 2009

(54) SMART ANTENNA WITH ADJUSTABLE RADIATION PATTERN

(75) Inventors: Ming-Iu Lai, Taipei (TW); Tzung-Yu Wu, Taipei (TW); Chun-Hsiung Wang, Taipei (TW); Yung-Chi Fan, Taipei (TW)

(73) Assignee: Asustek Computer Inc., Peitou, Taipei (TW)

( * ) Notice: Subject to any disclaimer, the term of this patent is extended or adjusted under 35 U.S.C. 154(b) by 235 days.

(21) Appl. No.: 11/759,399

(22) Filed: Jun. 7, 2007

(65) Prior Publication Data

US 2008/0303732 A1 Dec. 11, 2008

(51) Int. Cl.
*H01Q 13/10* (2006.01)
*H01Q 21/00* (2006.01)

(52) U.S. Cl. ..... 343/770; 343/853

(58) Field of Classification Search ..... 343/767, 343/770, 853, 876

See application file for complete search history.

(56) References Cited

U.S. PATENT DOCUMENTS 6,864,848 B2 * 3/2005 Sievenpiper ..... 343/767
7,106,270 B2 * 9/2006 Iigusa et al. ..... 343/833

* cited by examiner

*Primary Examiner*—Michael C Wimer
(74) *Attorney, Agent, or Firm*—Thomas, Kayden, Horstemeyer & Risley

(57) ABSTRACT

A smart antenna with an adjustable radiation pattern is described. A plurality of slot antennas are formed at a metal layer which is grounded, wherein openings of the slot antennas point to different directions. One surface of an insulated layer is covered by the metal layer. A coaxial feeding structure is provided through the insulated layer. A plurality of microstrip lines are formed at the other surface of the insulated layer and can feed the radio frequency signals to the slot antennas, respectively. Pluralities of switches are connected to each microstrip line and the coaxial feeding structure. A plurality of bias circuits are electrically connected to each switch, respectively, to control the status of the switch and adjust the operation statuses of the slot antennas individually to form an adjustable radiation pattern.

14 Claims, 7 Drawing Sheets status: 0 : closed
1 : operating measured radiation pattern simulated radiation pattern

SMART ANTENNA WITH ADJUSTABLE RADIATION PATTERN

BACKGROUND OF THE INVENTION

1. Field of the Invention

The invention is related to a smart antenna and, more particularly, to a smart antenna with an adjustable radiation pattern.

2. Description of the Related Art

A traditional smart antenna technology is often achieved by an array antenna with a tunable phase shifters. Take a traditional four-element array antenna with a half-wavelength spacing as example. When the phase shifter of each antenna element differs from each other by 60 degrees, the radiation beam will move to nearly 20 degrees. For an array antenna, the shape of its radiation pattern or the null directions in the radiation pattern can be controlled by dynamically adjusting the phase shifter. However, the phase shifter which can be dynamically adjusted has a high cost, so that the bottle neck of this design method is the high design cost. On the other hand, the separation between two antenna elements in the array antenna is usually designed to be a half wavelength, so that the antenna is difficult to be designed to be miniature. The above various problems make the smart antenna unsuitable to be used in information electronic products.

BRIEF SUMMARY OF THE INVENTION

The invention provides a smart antenna with an adjustable radiation pattern.

According to one embodiment of the invention, a smart antenna with an adjustable radiation pattern is provided. The smart antenna includes a metal layer, a plurality of slot antennas, an insulated layer, a coaxial feeding structure, a plurality of microstrip lines, a plurality of switches and a plurality of bias circuits. Wherein, the plurality of slot antennas are formed at the metal layer which is grounded. The openings of the slot antennas point to different directions. One surface of the insulated layer covers the metal layer. The coaxial feeding structure is provided through the insulated layer and the part of the coaxial feeding structure is electrically connected to the metal layer. The plurality of the microstrip lines are formed at the other surface of the insulated layer, and the microstrip lines can feed the radio frequency (RF) signals to each slot antenna, respectively. The plurality of the switches are used to connect the coaxial feeding structure and each microstrip line. Each bias circuit is electrically connected to each switch to control the status of the switch and adjust the operation status of the slot antennas individually, so that the radiation pattern of the antenna can be adjusted.

Therefore, the radiation pattern of the smart antenna of the invention can be adjusted to be needed by switching the operation status of the plurality of slot antennas. Moreover, the smart antenna can be designed to be miniature and used in various light and small information electronic products.

BRIEF DESCRIPTION OF THE DRAWINGS

These and other features, aspects, and advantages of the present invention will become better understood with regard to the following description, appended claims, and accompanying drawings.

DETAILED DESCRIPTION OF THE EMBODIMENTS

The invention provides a smart antenna with an adjustable radiation pattern. Since it is easy to be miniature, it can be used in various light and small information electronic products. The details of the invention are described via the embodiments, wherein the slot antennas are L slot antennas.

Figure 1:
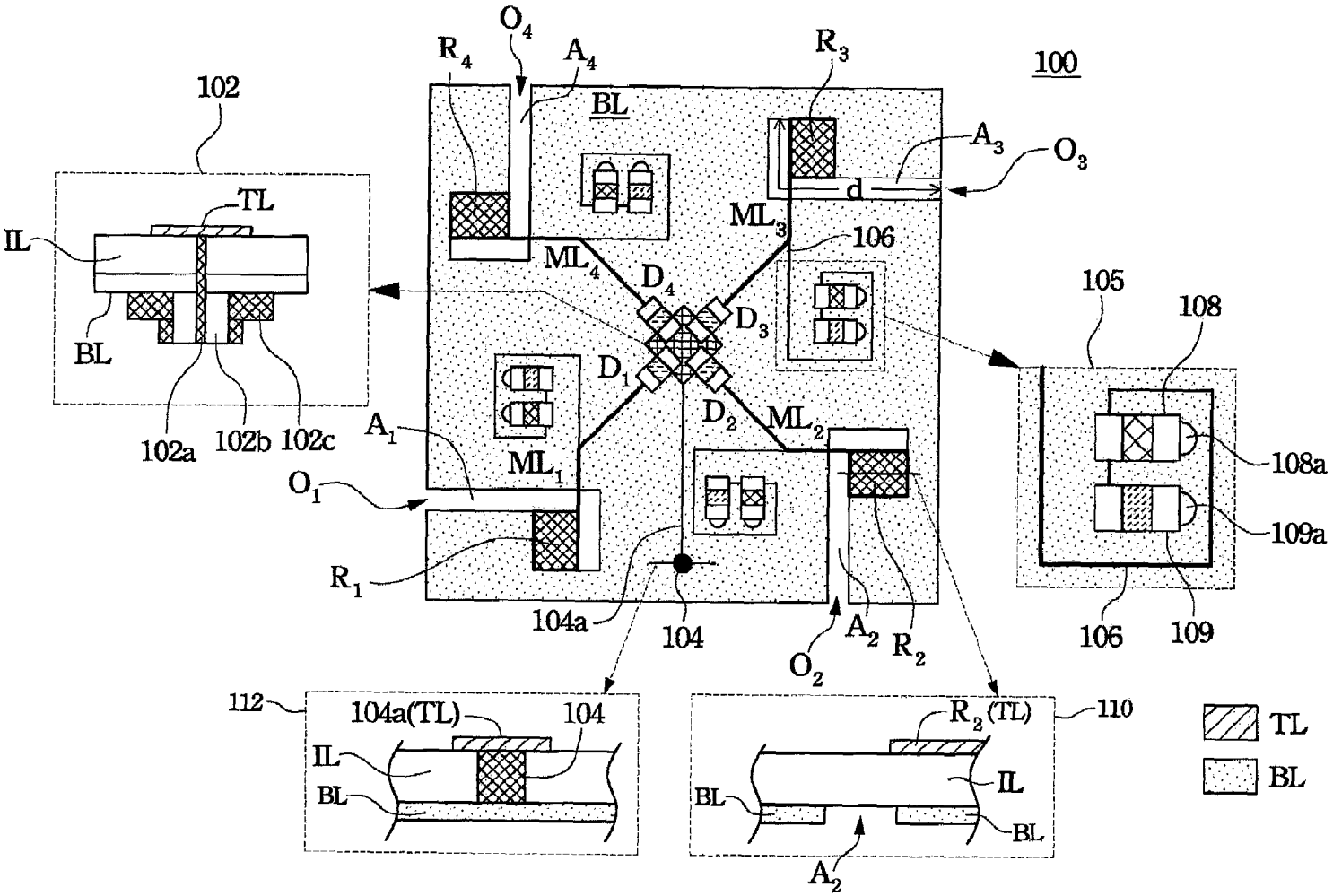
FIG. 1 shows a smart antenna with an adjustable radiation pattern of a preferred embodiment of the invention.

Please refer to FIG. 1 which shows a smart antenna with an adjustable radiation pattern of a preferred embodiment of the invention. The smart antenna 100 includes four L slot antennas $A_1$, $A_2$, $A_3$, and $A_4$ which are formed on a metal ground layer BL. The insulated layer IL is not drawn on the top view of the smart antenna 100 shown in the center of FIG. 1. The L slot antenna is based on the L slot etched in the ground layer BL. The length d of the L slot is about a quarter of the wavelength of a radiation frequency (RF) signal. The number of the L slot antennas depends on the need and is not limited to be four.

In the embodiment, the openings O1, O2, O3, and O4 of the four L slot antennas $A_1$, $A_2$, $A_3$, and $A_4$ point to four different directions, respectively, and the included angles between the directions of the openings are equal (90 degrees). In other embodiments, the smart antenna can include three L slot antennas, and the included angles between the directions of the openings can be 120 degrees.

The smart antenna 100 further includes an insulated layer IL covering the metal ground layer BL. The majority of other antenna components are formed at the top layer TL which is on the insulated layer IL.

A coaxial feeding structure 102 is provided through the insulated layer IL (please refer to the section of the coaxial feeding structure 102 shown in FIG. 1.), and the distance between the coaxial feeding structure 102 and each L slot antenna is nearly the same. The coaxial feeding structure 102 includes a probe 102*a*, a coaxial insulated layer 102*b* and a metal 102*c*, shown in FIG. 1. The coaxial insulated layer 102*b* is used to insulate the probe 102*a* from the metal 102*c*.

The smart antenna 100 further needs four microstrip lines $ML_1$, $ML_2$, $ML_3$ and $ML_4$ (on the top layer TL) to connect the four switches $D_1$, $D_2$, $D_3$, and $D_4$ and four rectangular metal sheets $R_1$, $R_2$, $R_3$, and $R_4$. The rectangular metal sheets $R_1$, $R_2$, $R_3$, and $R_4$ are on the insulated layer IL. Refer to section 110 shown in FIG. 1, the microstrip lines $ML_1$, $ML_2$, $ML_3$ and $ML_4$ are open circuit microstrip lines. Each slot antenna $A_1$, $A_2$, $A_3$, and $A_4$ is fed by the open circuit microstrip line. The rectangular metal sheets $R_1$, $R_2$, $R_3$, and $R_4$ are not electrically connected to the L slot antennas $A_1$, $A_2$, $A_3$, and $A_4$ in the substantiality (no through holes on the insulated layer IL between the rectangular metal sheets and the L slot antennas).

Four switches $D_1$, $D_2$, $D_3$, and $D_4$ (on the top layer TL) are electrically connected to the microstrip lines $ML_1$, $ML_2$, $ML_3$, $ML_4$ and the coaxial feeding structure 102. The switches $D_1$, $D_2$, $D_3$, and $D_4$ can be Positive-Intrinsic-Negative (PIN) diodes or other kinds of switches. In the embodiment, the switches $D_1$, $D_2$, $D_3$, and $D_4$ are the PIN diodes, and the P-type sides are electrically connected to each microstrip line, while the N-type sides are electrically connected to the probe 102*a* of the coaxial feeding structure 102.

Four bias circuits 105 (on the top layer TL) are electrically connected to each switch (via microstrip lines $ML_1$, $ML_2$, $ML_3$, and $ML_4$) to control the status of the switches $D_1$, $D_2$, $D_3$, and $D_4$ and to adjust the operation status of the L slot antennas $A_1$, $A_2$, $A_3$, and $A_4$. For example, when the bias circuit 105 controls the $D_1$ switch to be ON-state and the other switches to be OFF-state, the L slot antenna $A_1$ is active, and the other L slot antennas are disable.

Each bias circuit 105 includes a microstrip line 106 (the length is about quarter wavelength of a RF signal), a capacitor 108 and a resistor 109. The capacitor 108 is electrically connected to the microstrip line 106 and the metal ground layer BL (by passing through a conducting via 108*a*). The resistor 109 is electrically connected to the microstrip line 106 and a bias voltage (which is on a controlling electrode 109*a*). The resistor 109 is used to limit the current flowing into the switch.

Please refer to the grounding section 112. A grounded conducting via 104 and a microstrip line 104*a* (on the top TL) are used to connect the coaxial feeding structure 102*a* and the metal ground layer BL. The length of the microstrip line 104*a* is about a quarter of the wavelength of a RF signal.

Please refer to FIG. 2-FIG. 11 showing ten kinds of radiation patterns of the smart antenna shown in FIG. 1, respectively. When users control the status of the four switches $D_1$, $D_2$, $D_3$, and $D_4$ via the four bias circuits 105, the smart antenna 100 can produce the following ten different kinds of the radiation patterns. The smart antenna 100 can maintain a preferred receiving and transmitting efficiency by switching to a needed radiation pattern (one of the ten kinds of the radiation pattern).

Figure 2:
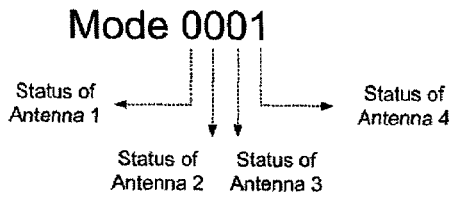
FIG. 2-FIG. 11 shows ten kinds of radiation patterns of the smart antenna shown in FIG. 1, respectively.
Figure 2:
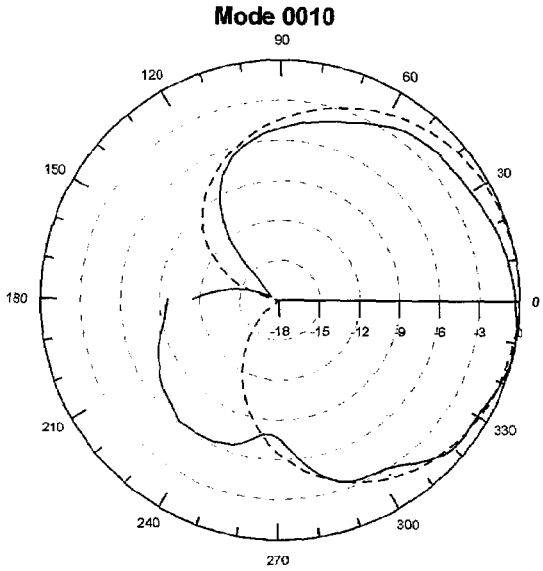

Please refer to FIG. 2, which shows the radiation pattern of the smart antenna 100 when the antenna $A_3$ operates and the others do not operate.

Figure 3:
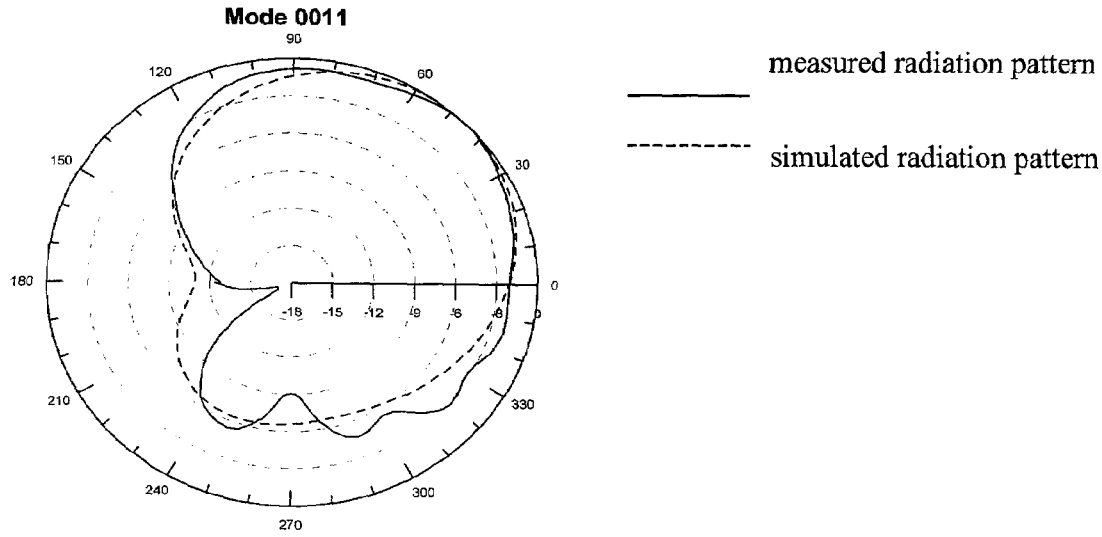

Please refer to FIG. 3, which shows the radiation pattern of the smart antenna 100 when the antennas $A_3$ and $A_4$ operate and the others do not operate.

Figure 4:
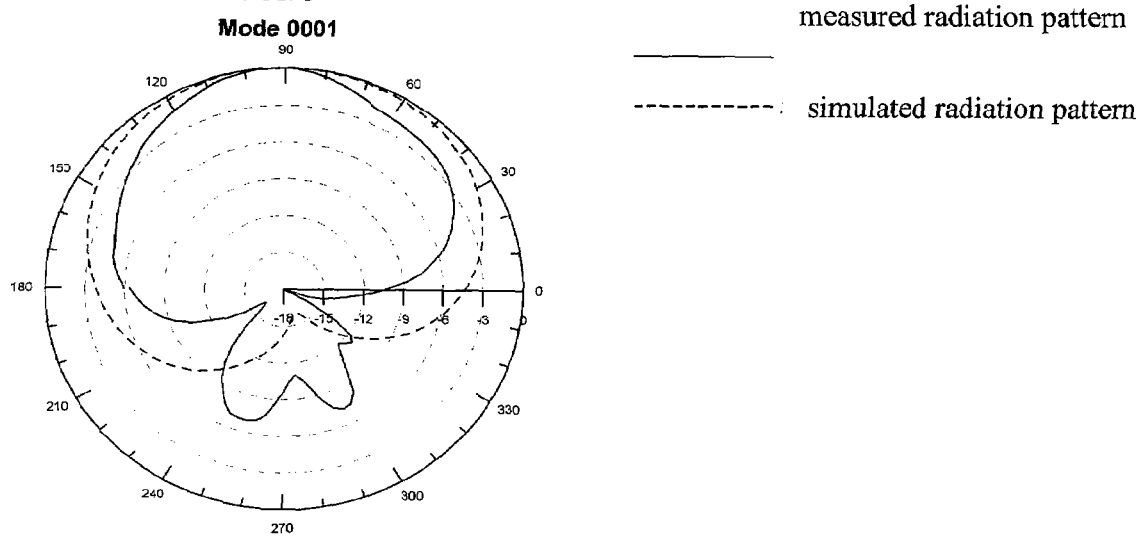

Please refer to FIG. 4, which shows the radiation pattern of the smart antenna 100 when the antennas $A_4$ operates and the others do not operate.

Figure 5:
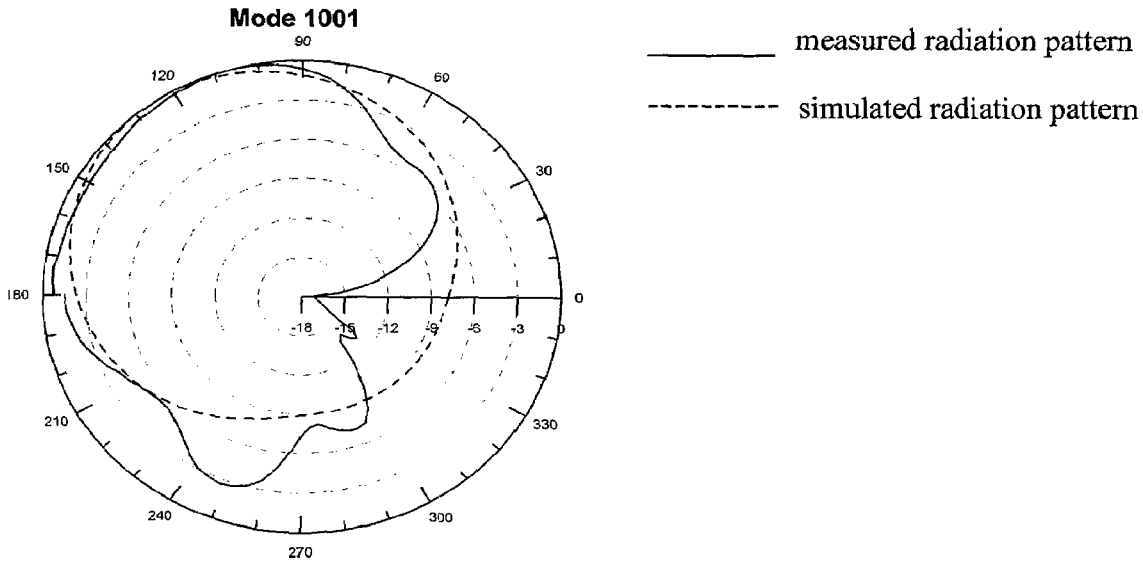

Please refer to FIG. 5, which shows the radiation pattern of the smart antenna 100 when the antennas $A_1$ and $A_4$ operate and the others do not operate.

Figure 6:
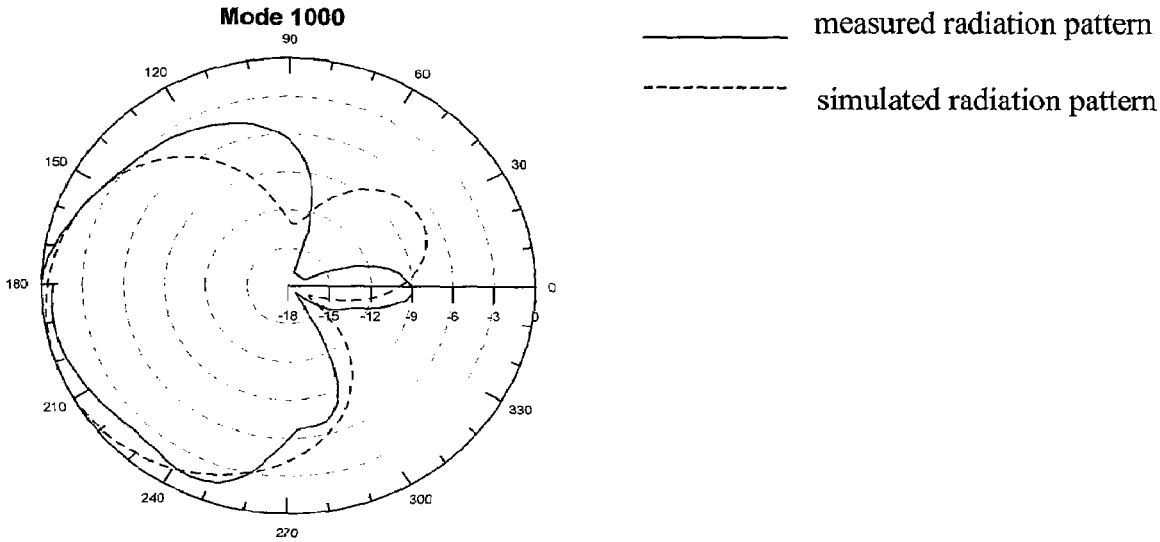

Please refer to FIG. 6, which shows the radiation pattern of the smart antenna 100 when the antennas $A_1$ operates and the others do not operate.

Figure 7:
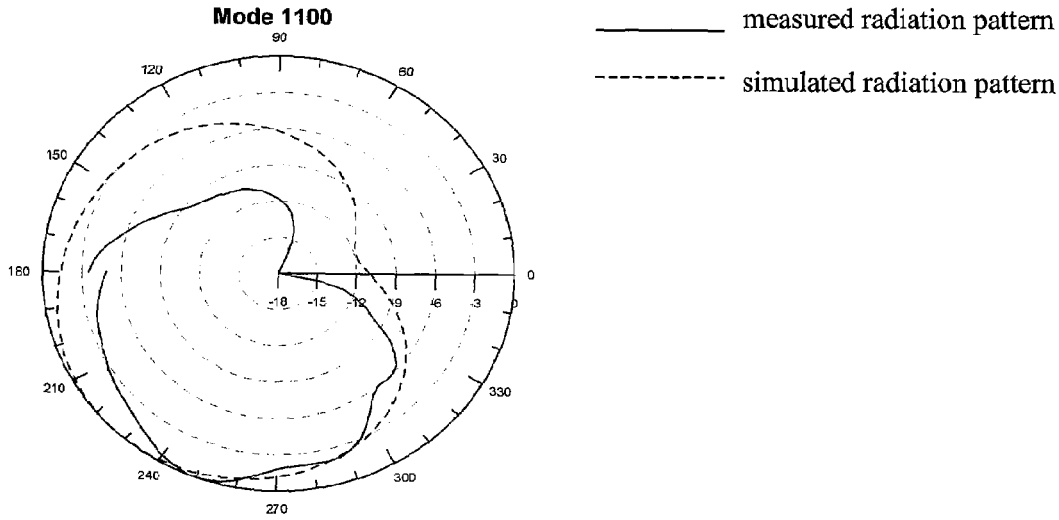

Please refer to FIG. 7, which shows the radiation pattern of the smart antenna 100 when the antennas $A_1$ and $A_2$ operate and the others do not operate.

Figure 8:
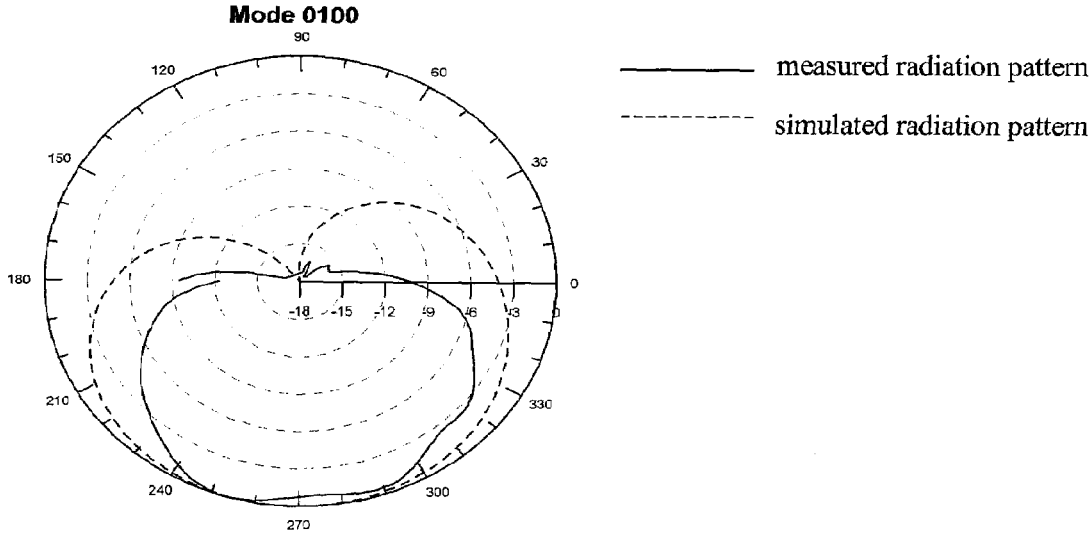

Please refer to FIG. 8, which shows the radiation pattern of the smart antenna 100 when the antennas $A_2$ operates and the others do not operate.

Figure 9:
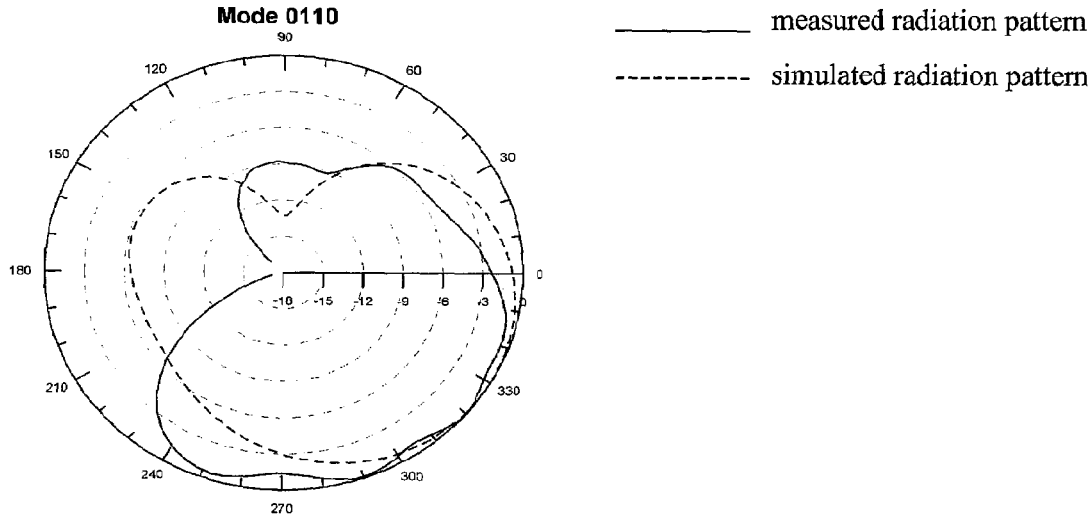

Please refer to FIG. 9, which shows the radiation pattern of the smart antenna 100 when the antennas $A_2$ and $A_3$ operate and the others do not operate.

Figure 10:
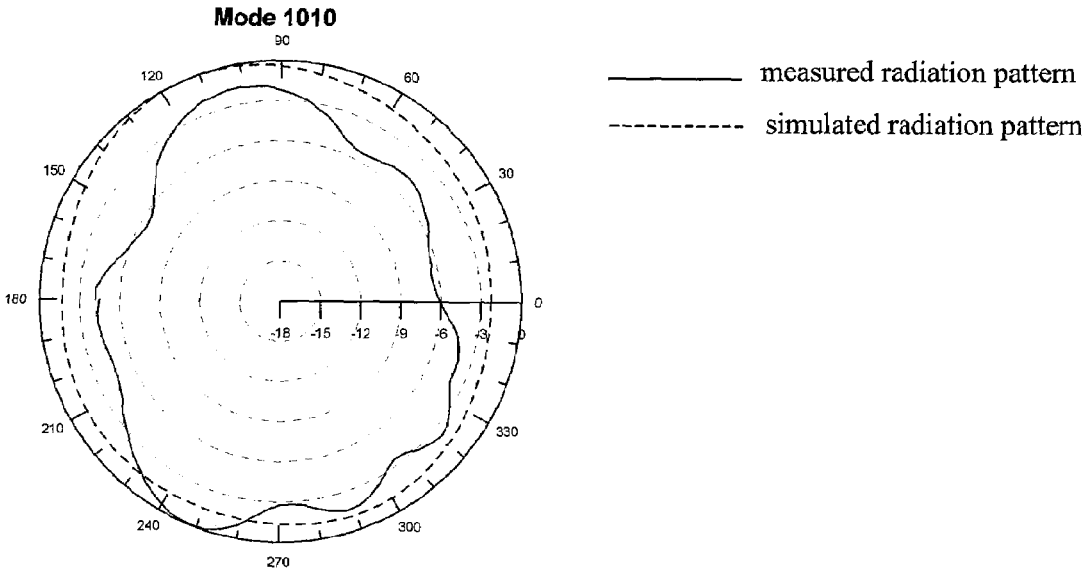

Please refer to FIG. 10, which shows the radiation pattern of the smart antenna 100 when the antennas $A_1$ and $A_3$ operate and the others do not operate.

Figure 11:
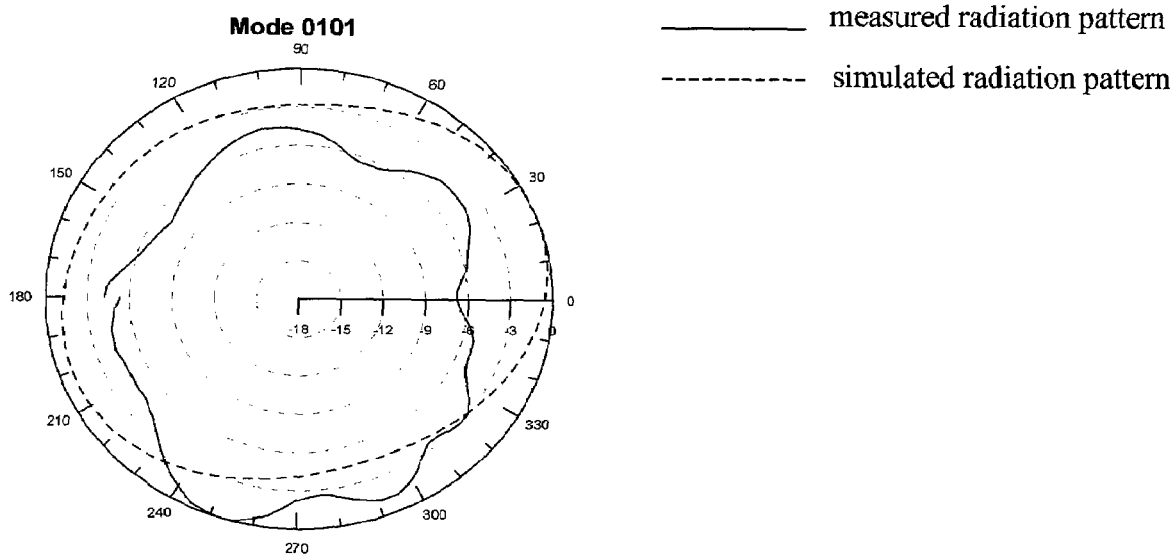

Please refer to FIG. 11, which shows the radiation pattern of the smart antenna 100 when the antennas $A_2$ and $A_4$ operate and the others do not operate.

From the preferred embodiment of the invention, we can know that using the smart antenna of the invention, the radiation pattern can be adjusted to be needed by switching the operation status of a plurality of L slot antennas.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A smart antenna with an adjustable radiation pattern comprising:

a metal layer which is grounded;

a plurality of slot antennas formed at the metal layer, wherein the openings of the slot antennas point to different directions;

an insulated layer whose one surface is covered by the metal layer;

a coaxial feeding structure provided through the insulated layer and the part of the coaxial feeding structure is electrically connected to the metal layer;

a plurality of microstrip lines formed on the other surface of the insulated layer, wherein the microstrip lines respectively can feed radio frequency signals to the slot antennas;

a plurality of switches for being electrically connected to the coaxial feeding structure and each of the microstrip lines; and a plurality of bias circuits respectively and electrically connected to each of the switches to control the status of the switches and adjust the operation status of the slot antennas individually so as to change the radiation pattern of the antenna.

2. The smart antenna with an adjustable radiation pattern according to claim 1, wherein the included angles between the directions of openings of the slot antennas are equal.

3. The smart antenna with an adjustable radiation pattern according to claim 1, wherein the slot antennas are the L slot antennas.

4. The smart antenna with an adjustable radiation pattern according to claim 3, wherein the L slot antennas are coplanar.

5. The smart antenna with an adjustable radiation pattern according to claim 4, wherein the L slot antennas comprise the four L slot antennas whose directions of the openings point to 0 degree, 90 degrees, 180 degrees and 270 degrees, respectively.

6. The smart antenna with an adjustable radiation pattern according to claim 1, wherein the distances between the coaxial feeding structure and each of the slot antennas are nearly the same.

7. The smart antenna with an adjustable radiation pattern according to claim 1, wherein the switches are the diodes.

8. The smart antenna with an adjustable radiation pattern according to claim 7, wherein the P-type sides of the diodes are electrically connected to each of the microstrip lines, and the N-type sides of the diodes are electrically connected to the coaxial feeding structure.

9. The smart antenna with an adjustable radiation pattern according to claim 1, wherein the microstrip lines are open circuit microstrip lines, and each slot antenna is fed by each open circuit microstrip line for radio frequency signals.

10. The smart antenna with an adjustable radiation pattern according to claim 1, wherein the coaxial feeding structure comprises a probe, a coaxial insulated layer and an external metal, and the insulated layer is used to insulate the probe and the external metal, the probe is connected to the switches, and the external metal is electrically connected to the metal layer.

11. The smart antenna with an adjustable radiation pattern according to claim 1, wherein one end of each microstrip line is electrically connected to the switch and the other end of the microstrip line is a rectangular metal sheet which is provided on the insulated layer.

12. The smart antenna with an adjustable radiation pattern according to claim 1, further comprises a microstrip line and a ground conducting via for electrically connecting the coaxial feeding structure to the metal layer, and the length of the microstrip line is about a quarter of the wavelength of a radio frequency signal.

13. The smart antenna with an adjustable radiation pattern according to claim 1, wherein each of the bias circuits comprises a microstrip line with a length of a quarter of the wavelength of a radio frequency signal, a capacitor, and a resistor.

14. The smart antenna with an adjustable radiation pattern according to claim 1, wherein the length of each of the slot antennas is about quarter wavelength of a radio frequency signal.

* * * * *